US007365716B2

(12) United States Patent
Kim et al.

(10) Patent No.: US 7,365,716 B2
(45) Date of Patent: Apr. 29, 2008

(54) LIGHT EMITTING DEVICE AND METHOD OF DRIVING THE SAME

(75) Inventors: Hak Su Kim, Seoul (KR); Jae Do Lee, Gumi-shi (KR); Su Jin Baek, Geoje-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/373,311

(22) Filed: Mar. 13, 2006

(65) Prior Publication Data

US 2007/0139308 A1 Jun. 21, 2007

(30) Foreign Application Priority Data

Dec. 14, 2005 (KR) ..... 10-2005-0123268

(51) Int. Cl.
*G09G 3/30* (2006.01)

(52) U.S. Cl. ..... 345/76; 315/169.3

(58) Field of Classification Search ..... 315/169.3; 345/60–102, 204, 211
See application file for complete search history.

(56) References Cited

U.S. PATENT DOCUMENTS

2004/0239597 A1* 12/2004 Tanabe ..... 345/76
2005/0280613 A1* 12/2005 Takei et al. ..... 345/76
2006/0125740 A1* 6/2006 Shirasaki et al. ..... 345/77

* cited by examiner

*Primary Examiner*—Duc Q Dinh
(74) *Attorney, Agent, or Firm*—Ked & Associates, LLP

(57) ABSTRACT

The present invention relates to a light emitting device for preventing cross-talk phenomenon. The light emitting device includes a plurality of pixels and a scan driving circuit. The pixels are formed in cross areas of data lines and scan lines. The scan driving circuit couples at least one scan line to a first voltage source having a first voltage during a first time, couples the scan line to a second voltage source having a second voltage during a second time, and couples the scan line to a third voltage source having a third voltage during a third time. Here, the second voltage is a voltage between the first voltage and the third voltage. The light emitting device discharges the data lines to the same level as data current irrespective of precharge current, and thus cross-talk phenomenon is not occurred to the light emitting device.

21 Claims, 8 Drawing Sheets

LIGHT EMITTING DEVICE AND METHOD OF DRIVING THE SAME

BACKGROUND OF THE INVENTION

1. Field of the Invention

The present invention relates to a light emitting device and a method of driving the same, more particularly relates to a light emitting device for preventing cross-talk phenomenon and a method of driving the same.

2. Description of the Related Art

A light emitting device emits a light having a certain wavelength. Especially, an organic electroluminescent device as the light emitting device is self light emitting device.

FIG. 1 is a sectional view illustrating schematically pixel included in a common organic electroluminescent device. FIG. 2 is a view illustrating schematically a circuitry of a passive-matrix type organic electroluminescent device. FIG. 3 is a timing diagram illustrating a process of driving the organic electroluminescent device.

In FIG. 2, the organic electroluminescent device includes a plurality of pixels 10.

Each of the pixels 10 includes an anode electrode layer 2, an hole transporting layer 3, an emitting layer 4, an electron transporting layer 5 and a cathode electrode layer 6 formed in sequence on an substrate 1 as shown in FIG. 1.

The anode electrode layer 2, the emitting layer 4 and the cathode electrode layer 6 are made up of transparent conductive material, organic material, and metal, respectively.

When a certain positive voltage and a negative voltage are provided to the anode electrode layer 2 and the cathode electrode layer 6, respectively, the hole transporting layer 3 transports holes generated from the anode electrode layer 2 to the emitting layer 4. In addition, the electron transporting layer 5 transports electrons generated from the cathode electrode layers 6 to the emitting layer 4. Subsequently, the transported holes and the transported electrons are recombined in the emitting layer 4, and so a light having a certain wavelength is emitted from the emitting layer 4.

There are a passive-matrix type organic electroluminescent device and an active-matrix type organic electroluminescent device as the organic electroluminescent device.

Hereinafter, the passive-matrix type organic electroluminescent device of the organic electroluminescent device will be described in detail.

In FIG. 2 and FIG. 3, the organic electroluminescent device includes a plurality of pixels 10 formed in cross areas of data lines D1 to Dm and scan lines S1 to Sn.

Scan signals SP1 to SPn are provided to the scan lines S1 to Sn, and so the scan lines S1 to Sn are connected in sequence to a ground.

Data signals, i.e. data current Id synchronized with the scan signals SP1 to SPn are provided to the data lines D1 to Dm. As a result, pixels corresponding to a scan line connected to the ground emits a light having the brightness corresponding to the data current Id.

A cross-talk phenomenon is occurred in the organic electroluminescent device. This will be explained in detail with reference to the accompanying drawings.

FIG. 4 is a plan view illustrating a picture displayed on the organic electroluminescent device.

In FIG. 4, a black picture is displayed on the center of the organic electroluminescent device, and a white picture is displayed on the other area thereof.

Hereinafter, a white picture area approximate to the black picture is assumed as a first white area A, and a white picture area over/under the first white area A is assumed as a second white area B.

Though data current having the same magnitude is provided to the first white area A and the second white area B so that light having the same brightness is emitted from the first white area A and the second white area B, the brightness of a light emitted from the first white area A is different from that of a light emitted from the second white area B. This is referred to as "Cross-talk phenomenon". The cross-talk phenomenon will be described in more detail with reference to the accompanying drawing.

FIG. 5 is a timing diagram illustrating a process of driving the organic electroluminescent device.

As shown in FIG. 5, since the first white area A displays the black picture, the amount of first precharge current provided to one data line in a second precharge time of a scan signal SP2 provided to a N+1 scan line is smaller than that of second precharge current provided to the data line in a first precharge time of a scan signal SP1 provided to a N scan line. In other words, the magnitude at a start point of a second luminescent time corresponding to the N+1 scan line is smaller than that at a start point of a first luminescent time corresponding to the N scan line.

Subsequently, data current having the same magnitude is provided to the data line during the first and second luminescent times so that the first white area A and the second white area B have the same brightness.

However, though the data current having the same magnitude is provided to the data line, a first pixel corresponding to the N+1 scan line and the data line has the brightness different from a second pixel corresponding to the N scan line and the data line because the amount of the first precharge current is different from that of the second precharge current. In other words, though the first white area A and the second white area B are preset to have the same brightness, the brightness of the first white area A is different from that of the second white area B. Accordingly, the display characteristics of the organic electroluminescent device might be deteriorated by the cross-talk phenomenon.

SUMMARY OF THE INVENTION

It is a feature of the present invention to provide a light emitting device for preventing cross-talk phenomenon and a method of driving the same.

A light emitting device according to one embodiment of the present invention includes a plurality of pixels and a scan driving circuit. The pixels are formed in cross areas of data lines and scan lines. The scan driving circuit couples at least one scan line to a first voltage source having a first voltage during a first time, couples the scan line to a second voltage source having a second voltage during a second time, and couples the scan line to a third voltage source having a third voltage during a third time. Here, the second voltage is a voltage between the first voltage and the third voltage.

An organic electroluminescent device according to one embodiment of the present invention includes a plurality of pixels, a precharging circuit, a data driving circuit and a scan driving circuit. The pixels are formed in cross areas of data lines and scan lines. The precharging circuit provides precharge current to the data lines during a precharge time. The data driving circuit provides data current to the data lines during a luminescent time. The scan driving circuit couples one scan line to a first voltage source having a first voltage during the precharge time, couples the scan line to a second voltage source having a second voltage during a delay time, and couples the scan line to a third voltage source having a third voltage during the luminescent time. Here, the delay time is a time between the precharge time and the luminescent time.

A method of driving a light emitting device having a plurality of pixels formed in cross areas of data lines and scan lines according to one embodiment of the present invention includes coupling one scan line to a first voltage source having a first voltage during a precharge time; coupling the scan line to a second voltage source having a second voltage during a delay time; and coupling the scan line to a third voltage source having a third voltage during a luminescent time. Here, the second voltage is a voltage between the first voltage and the third voltage.

As described above, a light emitting device and a method of driving the same according to one embodiment of the present invention discharge data lines to the same level as data current irrespective of precharge current, and thus cross-talk phenomenon is not occurred to the light emitting device.

BRIEF DESCRIPTION OF THE DRAWINGS

The above and other features and advantages of the present invention will become readily apparent by reference to the following detailed description when considered in conjunction with the accompanying drawings wherein.

DESCRIPTION OF EMBODIMENTS

Hereinafter, the preferred embodiments of the present invention will be explained in more detail with reference to the accompanying drawings.

Figure 6:
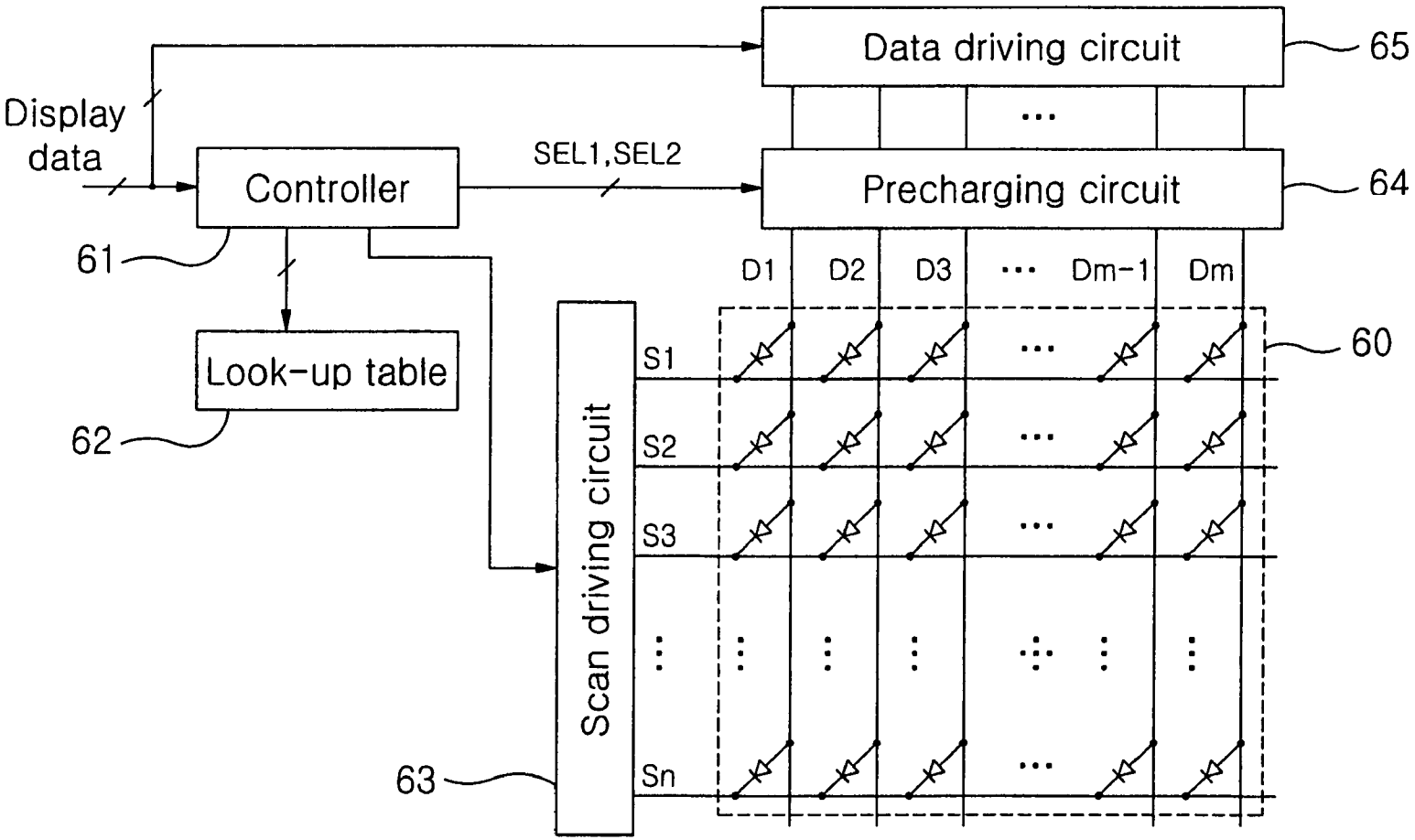
FIG. 6 is a block diagram illustrating a light emitting device according to one embodiment of the present invention.
Figure 7:
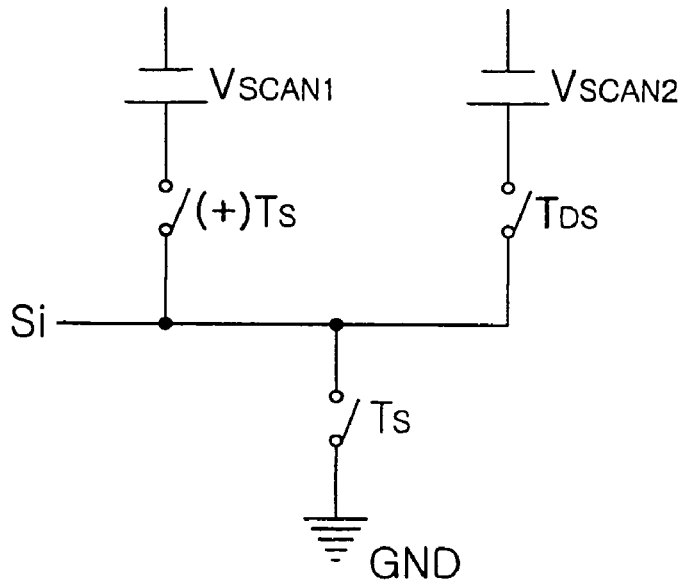
FIG. 7 is a view illustrating schematically a circuitry of a scan driving circuit according to one embodiment of the present invention.
Figure 8:
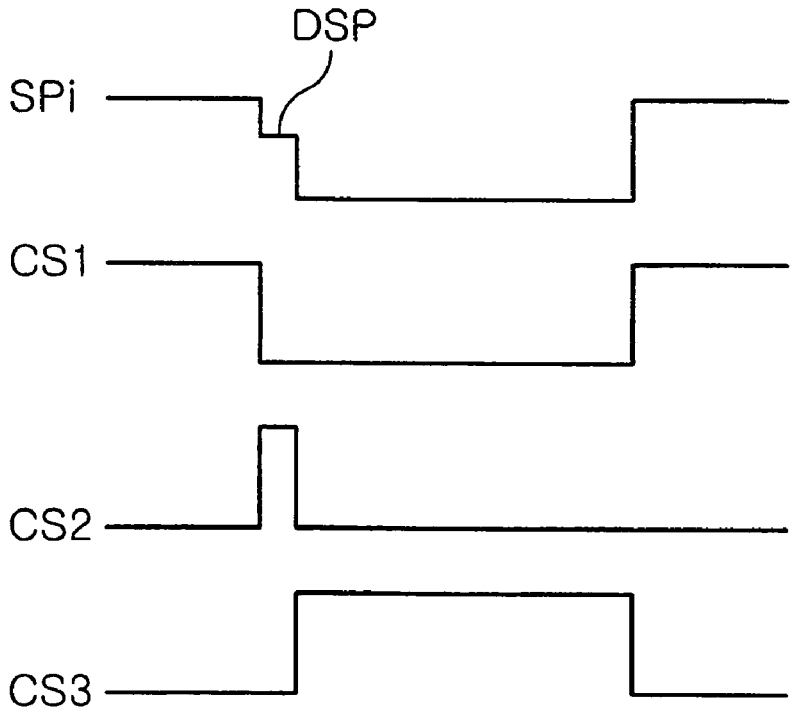
FIG. 8 is a timing diagram illustrating controlling signals provided to switches of FIG. 7.
Figure 9:
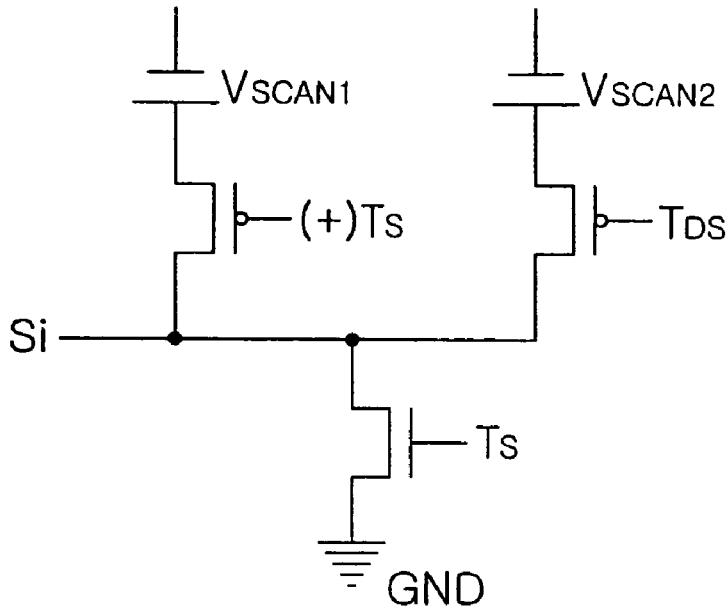
FIG. 9 is a view illustrating a circuitry of a scan driving circuit according to another embodiment of the present invention.
Figure 10:
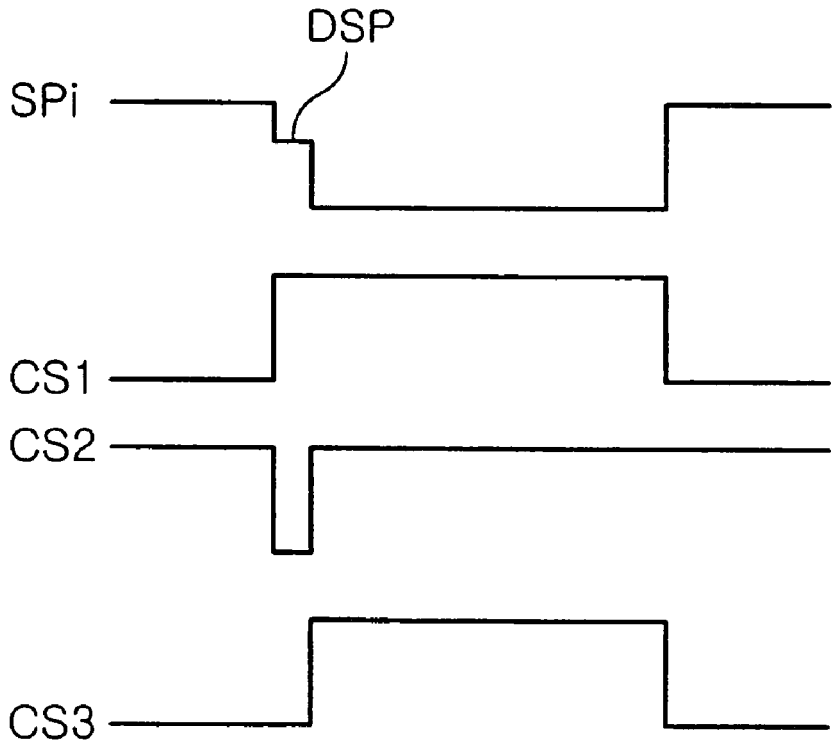
FIG. 10 is a timing diagram illustrating controlling signals provided to switches of FIG. 9.

FIG. 6 is a block diagram illustrating a light emitting device according to one embodiment of the present invention. FIG. 7 is a view illustrating schematically a circuitry of a scan driving circuit according to one embodiment of the present invention. FIG. 8 is a timing diagram illustrating controlling signals provided to switches of FIG. 7. FIG. 9 is a view illustrating a circuitry of a scan driving circuit according to another embodiment of the present invention. FIG. 10 is a timing diagram illustrating controlling signals provided to switches of FIG. 9.

The light emitting device according to one embodiment of the present invention includes an organic electroluminescent device, a plasma display panel, a liquid crystal display, and others. Hereinafter, the organic electroluminescent device will be described as an example of the light emitting device for convenience of the description.

In FIG. 6, the light emitting device of the present invention includes a panel 60, a controller 61, a scan driving circuit 63, a precharging circuit 64 and a data driving circuit 65.

The panel 60 includes a plurality of pixels 60 formed in cross areas of the data lines D1 to Dm and scan lines S1 to Sn.

The controller 61 receives display data, e.g. RGB data from an outside device, and controls the scan driving circuit 63 and the data driving circuit 65 using the received display data. In addition, the controller 61 detects the gray scale of the display data, and reads precharge current data corresponding to the detected gray scale from a look-up table 62. Then, the controller 61 generates controlling signals SEL1 and SEL2 corresponding to the precharge current data, and controls the precharging circuit 64 using the controlling signals SEL1 and SEL 2. Here, the first controlling signal SEL1 is a signal for controlling the precharging circuit 64 so that precharge current corresponding to the precharge current data is provided to the data lines D1 to Dm during a precharge time. However, the second controlling signal SEL2 is a signal for controlling the precharging circuit 64 so that the precharge current is cut off after the precharge time, and then data current is provided to the data lines D1 to Dm.

The look-up table 62 stores precharge current data corresponding to gray scale of the display data.

The precharging circuit 64 provides the precharge current to the data lines D1 to Dm, thereby precharging the data lines D1 to Dm.

The data driving circuit 65 provides data signals, i.e. data current corresponding to the display data to the precharged data lines D1 to Dm under the control of the controller 61.

The scan driving circuit 63 transmits in sequence scan signals to the scan lines S1 to Sn under the control of the controller 61. As a result, the scan lines S1 to Sn are coupled in sequence to a third voltage source, e.g. a ground. Here, a scan signal (SPi: $1 \leqq i \leqq n$) provided to a scan line coupled to the third voltage source has a delay time which is a time between the precharge time and a luminescent time. In this case, the scan signal has a second level voltage which is a voltage between a first level voltage corresponding to high logic and a second level voltage corresponding to low logic. In particular, the scan driving circuit 63 includes a first voltage source VSCAN1 for supplying a first level voltage to the scan lines S1 to Sn, a second voltage source VSCAN2 for supplying a second level voltage to the scan lines S1 to Sn, and a third voltage source, e.g. a ground for supplying a third level voltage to the scan lines S1 to Sn. Here, the second level voltage according to one embodiment of the present invention has the same magnitude as a driving voltage corresponding to the maximum brightness of a pixel in the light emitting device. Additionally, the scan driving circuit 63 further includes a first switch (+) Ts for switching connection between the scan lines S1 to Sn and the first voltage source VSCAN1, a second switch Tds for switching connection between the scan lines S1 to Sn and the second voltage source VSCAN2, and a third switch Ts for switching connection between the scan lines S1 to Sn and the third voltage source, e.g. the ground.

The switches (+) Ts, Tds and Ts connect the scan lines S1 to Sn to the first voltage source VSCAN1, the second voltage source VSCAN2, or the ground in accordance with an on-off controlling signal transmitted from a timing controller (not shown). Here, the switches (+) Ts, Tds and Ts are controlled by a first scan controlling signal CS1, a second scan controlling signal CS2, and a third scan controlling signal CS3, respectively as shown in FIG. 8.

At least one of the switches (+) Ts, Tds and Ts according to one embodiment of the present invention has MOS transistor. For example, each of the switches (+) Ts, Tds has P-MOS transistor, the switch Ts has a N-MOS transistor.

In short, the light emitting device of the present invention discharges the data lines D1 to Dm precharged by the precharge current during the delay time.

Figure 1:
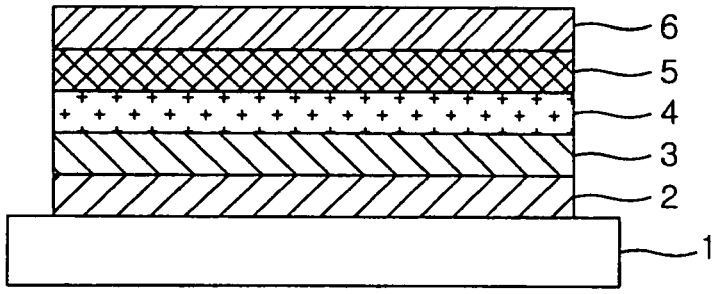
FIG. 1 [RELATED ART]
FIG. 1 is a sectional view illustrating schematically pixel included in a common organic electroluminescent device.
Figure 2:
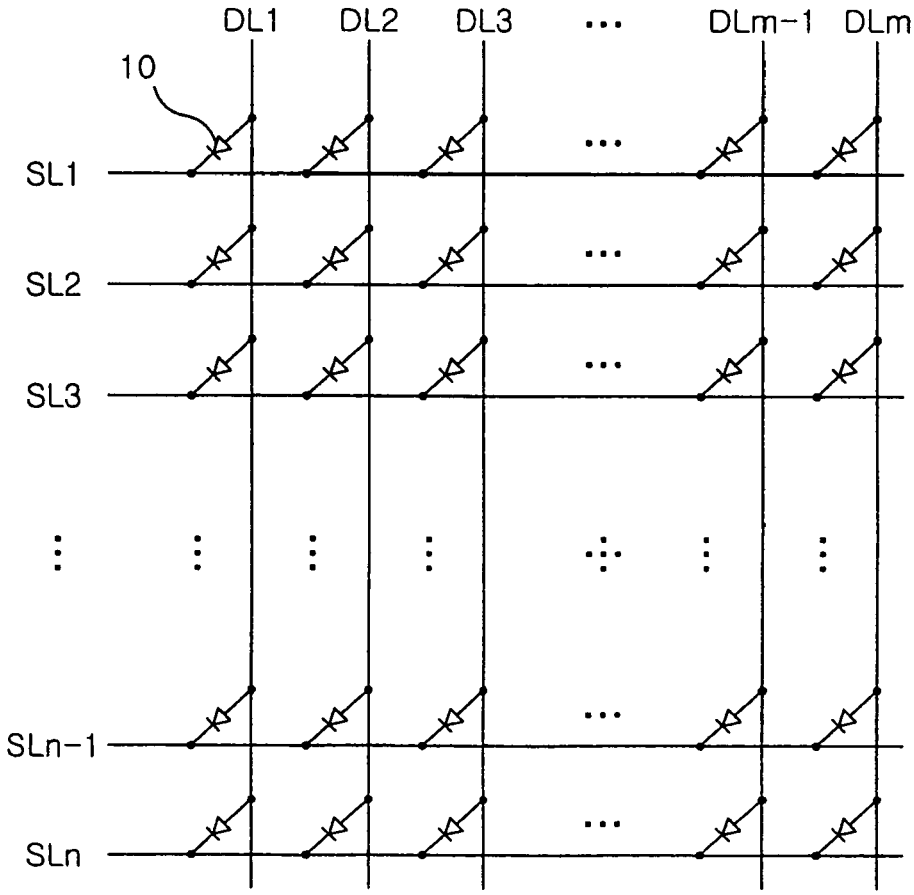
FIG. 2 [RELATED ART]
FIG. 2 is a view illustrating schematically a circuitry of a passive-matrix type organic electroluminescent device.
Figure 3:
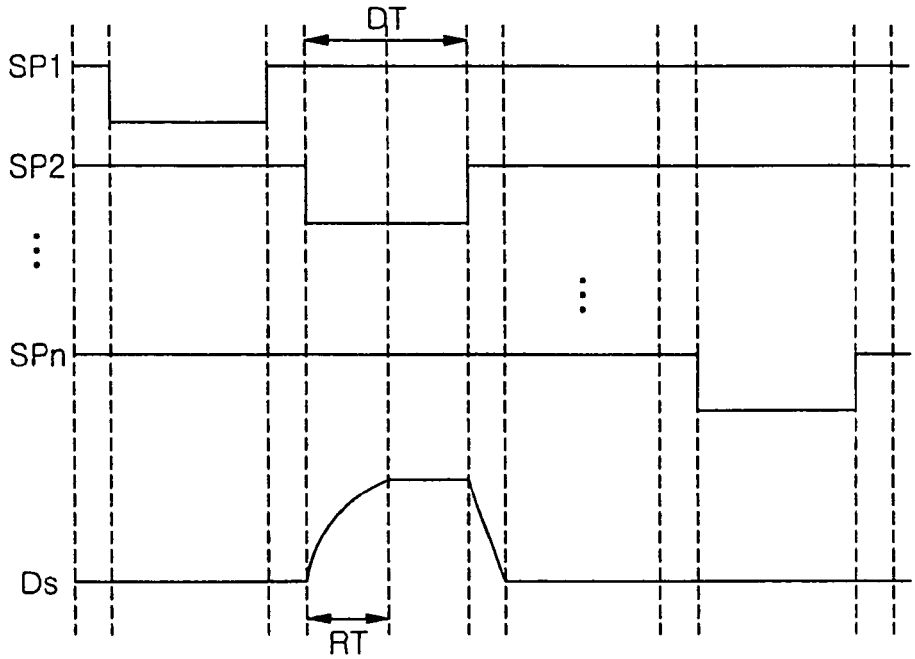
FIG. 3 [RELATED ART]
FIG. 3 is a timing diagram illustrating a process of driving the organic electroluminescent device.
Figure 4:
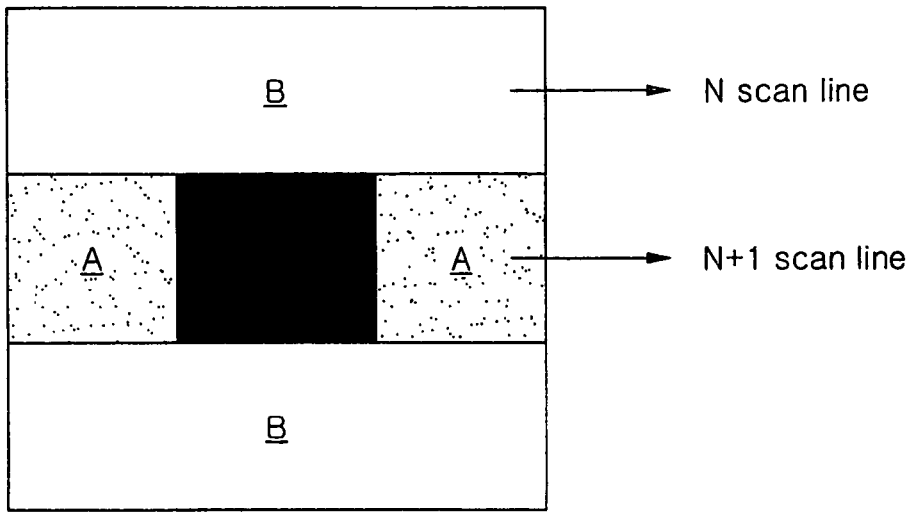
FIG. 4 [RELATED ART]
FIG. 4 is a plan view illustrating a picture displayed on the organic electroluminescent device.
Figure 5:
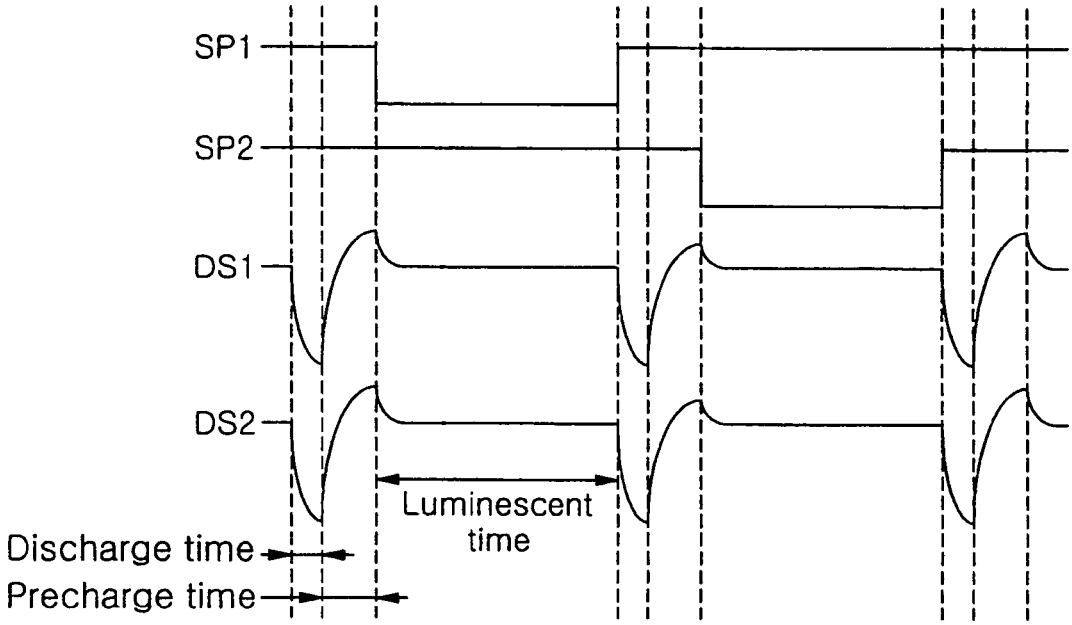
FIG. 5 [RELATED ART]
FIG. 5 is a timing diagram illustrating a process of driving the organic electroluminescent device.

In other words, the light emitting device of the present invention discharges the precharged data lines D1 to Dm during a delay time of the first scan signal SP1 provided to the N scan line corresponding to the second white area B shown in FIG. 4, and discharges the precharge data lines D1 to Dm during a delay time of the second scan signal SP2 provided to the N+1 scan line corresponding to the first white area A. Here, the data lines D1 to Dm are discharged to the same level as following data current. Then, the data current is provided to the data lines D1 to Dm during the luminescent time.

Hereinafter, a process of driving the light emitting device of the present invention will be described with reference to the accompanying drawings.

Figure 11:
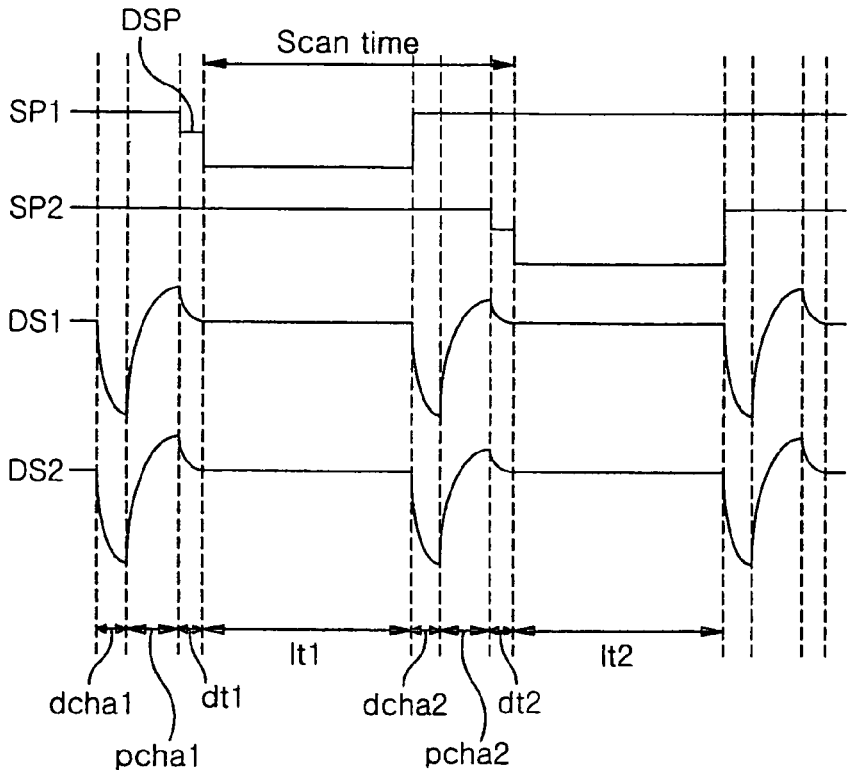
FIG. 11 is a timing diagram illustrating a process of driving the light emitting device according to one embodiment of the present invention.
Figure 12A:
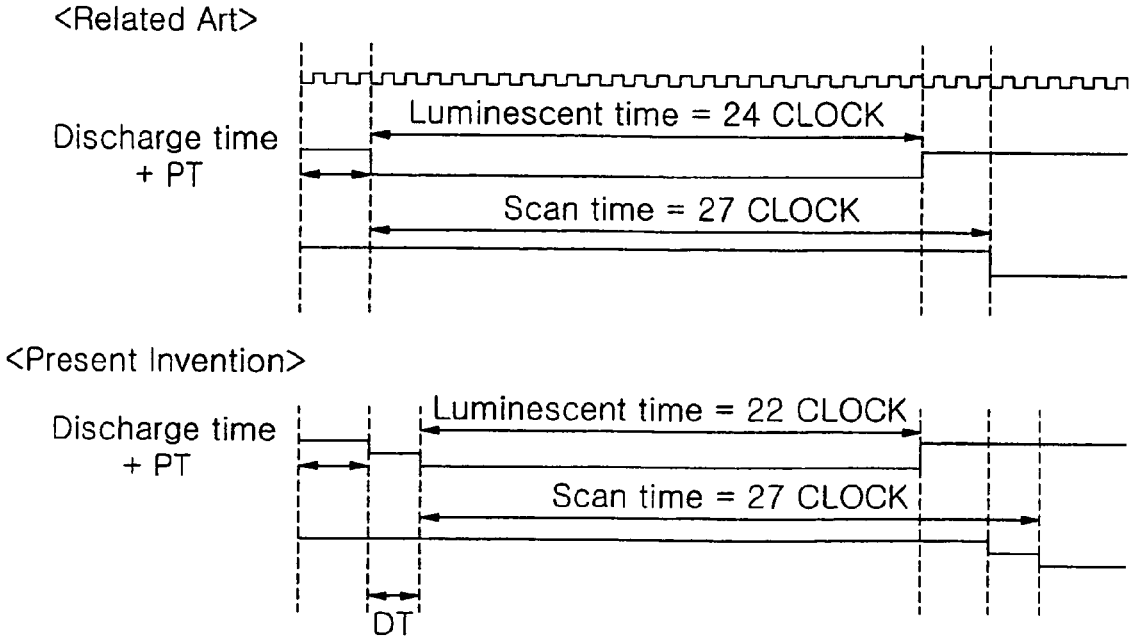
FIG. 12A and FIG. 12B are timing diagrams illustrating a method of setting the delay time and the luminescent time according to one embodiment of the present invention.
Figure 12B:
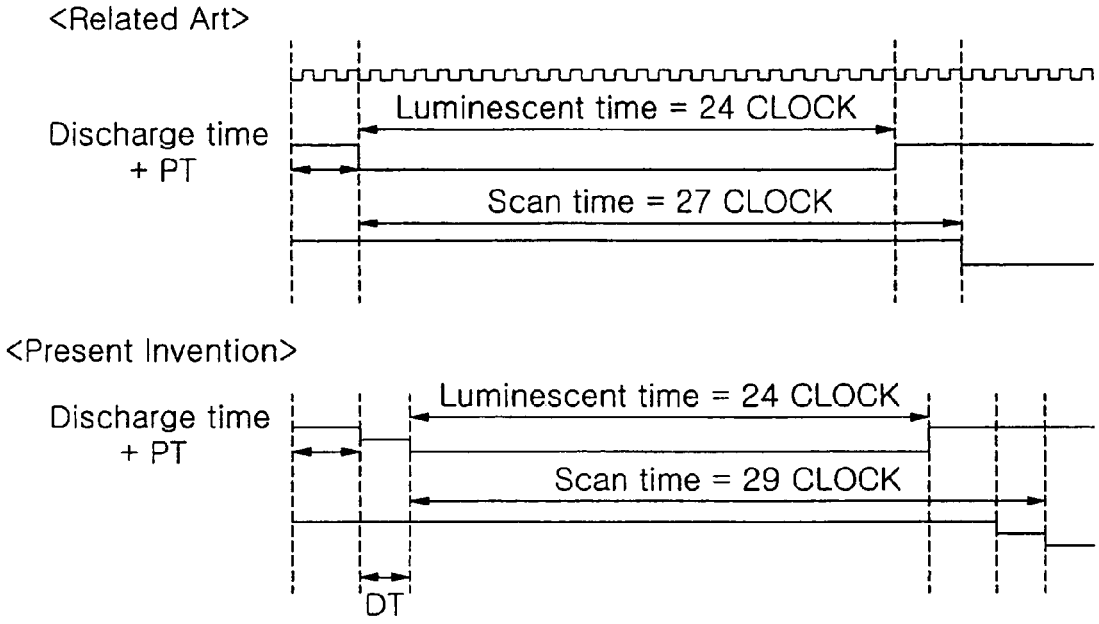

FIG. 11 is a timing diagram illustrating a process of driving the light emitting device according to one embodiment of the present invention. FIG. 12A and FIG. 12B are timing diagrams illustrating a method of setting the delay time and the luminescent time according to one embodiment of the present invention.

One data line located in only white area of the data lines D1 to Dm will be explained for the convenience of description. In addition, first data current I1 provided to the data line during a first luminescent time lt1 of the first scan signal provided to the N scan line is preset to have the same brightness as second data current I2 provided to the data line during a second luminescent time lt2 of the second scan signal provided to the N+1 scan line.

As shown in FIG. 11, the data line is discharged by a discharging circuit (not shown) during a first discharge time dcha1 in the first scan signal provided to the N scan line corresponding to the second white area B.

Subsequently, first precharge current is provided to the data line during a first precharge time pcha1, and so the discharged data line is precharged.

Then, the precharged data line is discharge to the same level as following first data current I1 during a first delay time dt1.

Subsequently, the first data current is provided to the discharged data line during a first luminescent time lt1, and so a first pixel corresponding to the data line and the N scan line emits a light.

Then, the data line is discharged during a second discharge time dcha2 in the second scan signal provided to the N+1 scan line corresponding to the first white area A.

Subsequently, second precharge current is provided to the data line during a second precharge time pcha2, and so the discharged data line is precharged.

Then, the precharged data line is discharged to the same level as following second data current I2 during a second delay time dt1.

Subsequently, the second data current I2 is provided to the discharged data line during a second luminescent time lt2, and thus a second pixel corresponding to the data line and the N+1 scan line emits a light.

As described above, the data line is discharged to the same level as the first data current I1 during the first delay time dt1 irrespective of the magnitude of the first precharge current. Moreover, the data line is discharged to the same level as the second data current I2 during the second delay time dt2 irrespective of the magnitude of the second precharge current. Here, since the data current I1 and I2 have the same magnitude, the pixels corresponding to the data line emit a light having the same brightness during the first luminescent time lt1 and the second luminescent time lt2. In other words, the pixels emit the light having the same brightness during the first luminescent time lt1 and the second luminescent time lt2 irrespective of the magnitude of the first precharge current and the second precharge current. Accordingly, cross-talk phenomenon is not occurred to the light emitting device of the present invention.

Hereinafter, a process of setting the delay time and the luminescent time in the light emitting device of the present invention will be described in detail with reference to FIG. 12A and FIG. 12B.

In FIG. 12A, the delay time and the luminescent time of a scan signal employed in the light emitting device of the present invention have the same length as a luminescent time in Related Art. In other words, the light emitting device of the present invention has the luminescent time smaller than the light emitting device described in Related Art. This delay time and luminescent time may be set by adjusting the number of clock as shown in FIG. 12A. For example, one scan time corresponds to 27 clocks. In this case, the length of the luminescent time in Related Art corresponds to 24 clocks, whereas the length of the luminescent time in the present invention is set to 22 clocks. Here, the number of the reduced clocks, i.e. 2 clocks is set as the delay time in the present invention. Accordingly, the frame frequency in the present invention is substantially identical to that in Related Art because the clock number of the luminescent time and the delay time in the present invention is substantially identical to that of the luminescent time in Related Art.

In FIG. 12B, the scan time in the light emitting device according to another embodiment of the present invention is longer than in Related Art. In this case, the length of the luminescent time in the light emitting device of the present invention is identical to that of the luminescent time in Related Art. The increased scan time is set as the delay time in the present invention as shown in FIG. 12B.

A method of setting the delay time in the present invention may be variously modified. However, it will be immediately obvious to those skilled in the art that many modifications for setting the delay time do not have any effect to the scope of the present invention.

In addition, a method of driving the light emitting device according to one embodiment of the present invention may be applied to an active-matrix type light emitting device as well as the passive-matrix type light emitting device.

From the preferred embodiments for the present invention, it is noted that modifications and variations can be made by a person skilled in the art in light of the above teachings. Therefore, it should be understood that changes may be made for a particular embodiment of the present invention within the scope and the spirit of the present invention outlined by the appended claims.

What is claimed is:

1. A light emitting device comprising:

a plurality of pixels formed in cross areas of data lines and scan lines; and a scan driving circuit configured to couple at least one scan line to a first voltage source having a first voltage during a first time, couple the scan line to a second voltage source having a second voltage during a second time, and couple the scan line to a third voltage source having a third voltage during a third time, wherein the second voltage is a voltage between the first voltage and the third voltage, wherein the first time includes a pre-charge time, the second time includes a delay time set before a luminescent time, and the third time includes the luminescent time.

2. The light emitting device of claim 1, wherein the third voltage source is a ground.

3. The light emitting device of claim 1, further comprising:

a precharging circuit configured to provide pre-charge current to one data line during the first time; and a data driving circuit configured to provide data current to the data line pre-charged by the pre-charge current during the third time.

4. The light emitting device of claim 3, wherein the data line is discharged to the same level as the data current when the scan line is coupled to the second voltage source.

5. The light emitting device of claim 3, further comprising:

a discharging circuit configured to discharge the data line; and a controller configured to control the precharging circuit, the data driving circuit and the discharging circuit.

6. The light emitting device of claim 1, wherein the first voltage has the same magnitude as a driving voltage of the light emitting device.

7. The light emitting device of claim 1, wherein the scan driving circuit further includes:

a first switch configured to switch connection of the scan line and the first voltage source;

a second switch configured to switch connection of the scan line and the second voltage source; and a third switch configured to switch connection of the scan line and the third voltage source.

8. The light emitting device of claim 7, wherein one or more of the switches include MOS transistor.

9. The light emitting device of claim 8, wherein each of the first and second switches includes P-MOS transistor, and the third switch has N-MOS transistor.

10. The light emitting device of claim 1, wherein the length of the second time and the third time is set as the number of clocks.

11. The light emitting device of claim 1, wherein the light emitting device is an organic electroluminescent device.

12. An organic electroluminescent device comprising:

a plurality of pixels formed in cross areas of data lines and scan lines;

a precharging circuit configured to provide precharge current to the data lines during a precharge time;

a data driving circuit configured to provide data current to the data lines during a luminescent time; and a scan driving circuit configured to couple one scan line to a first voltage source having a first voltage during the precharge time, couple the scan line to a second voltage source having a second voltage during a delay time, and couple the scan line to a third voltage source having a third voltage during the luminescent time, wherein the delay time is a time between the precharge time and the luminescent time and wherein the second voltage is a voltage between the first voltage and the third voltage.

13. The organic electroluminescent device of claim 12, wherein the first voltage has the same magnitude as a driving voltage of the organic electroluminescent device, and the third voltage source is a ground.

14. The organic electroluminescent device of claim 12, wherein the data line is discharged to the same level as the data current when the scan line is coupled to the second voltage source.

15. A method of driving a light emitting device having a plurality of pixels formed in cross areas of data lines and scan lines, comprising:

coupling one scan line to a first voltage source having a first voltage during a precharge time;

coupling the scan line to a second voltage source having a second voltage during a delay time; and coupling the scan line to a third voltage source having a third voltage during a luminescent time, wherein the second voltage is a voltage between the first voltage and the third voltage.

16. The method of claim 15, further comprising:

providing precharge current to at least one data line during the precharge time; and providing data current to the data line during the luminescent time.

17. The method of claim 16, wherein the data line precharged by the precharged current is discharged to the same level as the data current when the scan line is coupled to the second voltage source.

18. The method of claim 15, wherein the first voltage has the same magnitude as a driving voltage of the light emitting device, and the third voltage source is coupled to a ground.

19. The method of claim 15, wherein the scan line is coupled to the second voltage source during M (is a positive integer) clocks, and coupled to the third voltage source during N (is a positive integer higher than the M) clocks.

20. The light emitting device of claim 1, wherein the second time is between the first time and the third time.

21. The light emitting device of claim 1, wherein the first voltage is greater than the second and third voltages, and the second voltage is greater than the third voltage.

* * * * *